United States Patent [19]

Drake et al.

[11] Patent Number: 5,030,971

[45] Date of Patent: Jul. 9, 1991

[54] PRECISELY ALIGNED, MONO- OR MULTI-COLOR, 'ROOFSHOOTER' TYPE PRINTHEAD

[75] Inventors: Donald J. Drake, Rochester; William G. Hawkins, Webster, both of N.Y.

[73] Assignee: Xerox Corporation, Stamford, Conn.

[21] Appl. No.: 442,574

[22] Filed: Nov. 29, 1989

[51] Int. Cl.[5] ..... B41J 2/05

[52] U.S. Cl. ..... 346/140 R

[58] Field of Search ..... 346/140

[56] References Cited

U.S. PATENT DOCUMENTS

| | | | |
|---|---|---|---|
| 4,429,321 | 1/1984 | Matsumoto | 346/140 |
| 4,458,256 | 7/1984 | Shirato | 346/140 |
| 4,549,191 | 10/1985 | Fukuchi et al. . | |
| 4,568,953 | 2/1986 | Aoki et al. . | |
| 4,601,777 | 7/1986 | Hawkins et al. . | |
| 4,630,076 | 12/1986 | Yoshimura . | |
| 4,651,164 | 3/1987 | Abe et al. . | |
| 4,746,935 | 5/1988 | Allen . | |
| 4,750,009 | 6/1988 | Yoshimura . | |
| 4,789,425 | 12/1988 | Drake et al. . | |
| 4,791,440 | 12/1988 | Eldridge | 346/140 |
| 4,812,859 | 3/1989 | Chan et al. . | |
| 4,833,491 | 5/1989 | Rezanka . | |
| 4,887,098 | 12/1989 | Hawkins | 346/140 |
| 4,899,181 | 2/1990 | Hawkins | 346/140 |
| 4,914,736 | 4/1990 | Matsuda | 346/140 |
| 4,947,192 | 8/1990 | Hawkins | 346/140 |

*Primary Examiner*—Joseph W. Hartary
*Attorney, Agent, or Firm*—Oliff & Berridge

[57] ABSTRACT

A multi-color roofshooter type thermal ink jet printhead includes a common heater substrate having at least two arrays of heating elements and a corresponding number of elongated feed slots, each heater array being located adjacent its corresponding feed slot. A common channel substrate is layered above a heater substrate and includes arrays of nozzles corresponding in number to the arrays of heating elements, each nozzle array communicating with one of the feed slots on the heater substrate. Each nozzle array is isolated from an adjacent nozzle array and each nozzle of each nozzle array is aligned above a respective heating element of a corresponding heater array. Each of the heater arrays is individually addressed and driven by switching circuitry located on the heater substrate adjacent to its corresponding heater array. The switching circuitry can be active driver matrices corresponding in number to the arrays of heating elements. The locations of the driver matrices preferably alternate with locations of the feed slots. With this construction, multi-color printheads can be efficiently arranged on a single wafer, so that silicon real estate is conserved. The switching circuitry can also be used to address an array of heating elements in a mono-color thermal inkjet printhead. In a preferred embodiment, inputs of the switching circuitry extend from sides of the switching circuitry whereby distances between adjacent feed slots are minimized.

6 Claims, 9 Drawing Sheets

PRECISELY ALIGNED, MONO- OR MULTI-COLOR, 'ROOFSHOOTER' TYPE PRINTHEAD

BACKGROUND OF THE INVENTION

1. Field of the Invention

The present invention involves mono- or multi-color printheads and particularly heater plates for four color roofshooter printheads. The present invention also involves the use of switching circuitry for controlling the actuation of a plurality of heating elements in a mono- or multi-colored thermal ink jet printhead.

2. Description of Related Art

There are two general configurations for thermal drop-on-demand inkjet printheads. In one configuration, droplets are propelled from nozzles in a direction parallel to the flow of ink in ink channels and parallel to the surface of the bubble generating heating elements of the printhead, such as, for example, the printhead configuration disclosed in U.S. Pat. No. 4,601,777 to Hawkins et al. This configuration is sometimes referred to as "edge or side shooters". The other thermal ink jet configuration propels droplets from nozzles in a direction normal to the surface of the bubble generating heating elements, such as, for example, the printhead disclosed in U.S. Pat. No. 4,568,953 to Aoki et al. and U.S. Pat. No. 4,789,425 to Drake et al. This latter configuration is sometimes referred to as a "roofshooter".

In roofshooters, it is often desirable to supply ink to the nozzles via a passageway through the heater plates. This is the most advantageous choice because the proximity of the paper to the printhead makes any other design approach difficult. In a commercial drop-on-demand thermal inkjet printer sold by the Hewlett-Packard Company known as the THINK JET, the printhead comprises a heater plate and a fluid distributor plate. The heater plate is a glass substrate having the heating elements and addressing electrodes formed thereon with a hole drilled or isotropically etched, so that the ink can be fed through the heater plate to a shallow reservoir in the fluid distributor plate which is made by electroforming a material such as nickel over a three-dimensional mandrel. The apertures or nozzles in the fluid distributor plate are provided by thick film resist spot patterns formed on the mandrel prior to initiation of the electroform process. When the heater plate and the fluid distributor plate are aligned and bonded together, the contour of the fluid distributor plate forms the shallow reservoir mentioned above and the ink channels to the apertures that serve as droplet emitting nozzles. The ink travels through the drilled or etched hole and across the plane of the heater plate, thus also across the addressing electrodes, to the nozzles. There are two major disadvantages of this configuration. One is that it exposes the electrodes to the ink whenever there are any pin holes in the passivation layer. Secondly, the ink reservoir is quite shallow because it must be formed by the electroform. The shallow reservoir tends to permit the ink to dry out in the nozzles, causing first drop problems.

In the "roofshooter" printhead disclosed in U.S. Pat. No. 4,789,425 assigned to Xerox Corporation, the printhead comprises a silicon heater plate and a fluid directing structural member. The heater plate has a linear array of heating elements, associated addressing electrodes, and an elongated ink feed slot parallel with the heating element array. The structural member contains at least one recess cavity, a plurality of nozzles, and a plurality of parallel walls within the recess cavity which define individual ink channels for directing ink to the nozzles. The recess cavity and feed slot are in communication with each other and form the ink reservoir within the printhead. The ink holding capacity of the feed slot is larger than that of the recess cavity. The feed slot is precisely formed and positioned within the heater plate by anisotropic etching. The structural member may be fabricated either from two layers of photoresist, a two stage flat nickel electroform, or a single photoresist layer and a single stage flat nickel electroform.

The heater plate of the basic roofshooter-type thermal inkjet printhead can be modified to provide a four color printhead. When fabricating multi-colored printheads, the heater plate 28 (FIG. 1) must contain a feed slot 20 and an associated array of heating elements 34 for each color (usually black, magenta, cyan and yellow). When "passive resistor arrays" disclosed in U.S. Pat. No. 4,789,425 and shown in FIG. 1 are used, the electrical leads 33 for each resistive heating element 34 must run to the sides of the feed slot 20 and each resistive heating element 34 requires its own addressing electrode 32. The common return 35 for the heating elements also runs to the sides of the feed slot 20 and terminates at addressing electrodes 37. For multi-colors, it is desirable to place each color array on the same chip so that they are well aligned with one another. However, a problem arises in that each heater array consumes a large amount of surface area (referred to as silicon real estate) on the upper surface of each silicon wafer.

FIG. 2 shows one way of designing a four color roofshooter printhead using passive resistor arrays wherein the printhead is divided into two banks, each bank having two color feed slots (i.e., the first upper bank in FIG. 2 including black feed slot 20B and magenta feed slot 20M and the second lower bank including cyan feed slot 20C and yellow feed slot 20Y). While this design permits four color arrays to be placed on a single wafer subunit S, the printer is required to store information on two scan lines rather than one because of the two banks. While it would be desirable to place all four color arrays in a single bank, this is not practical because the inner color arrays consume considerable silicon real estate due to the fact that their electrical leads must all run to the sides.

U.S. Pat. No. 4,746,935 to Allen, assigned to Hewlett-Packard Company, discloses a method and apparatus useful for eight level halftone thermal inkjet printing by printing with droplets of ink having volumes weighted in a binary sequence. A four color roofshooter-type printhead which includes sets of three weighted drop generators for each color permits printing to be performed in eight levels with four colors.

U.S. Pat. No. 4,630,076 to Yoshimura discloses a four color ink jet printhead which additionally emits white or transparent ink droplets. This printhead includes multiple nozzles for each color. The structure for the present heater plate is not disclosed.

U.S. Pat. No. 4,549,191 to Fukuchi et al. discloses a multi nozzle ink drop-on-demand type of ink jet printing head which is able to deliver ink drops at a higher rate of speed through the use of capillary action. This printhead uses a driving transducer to form the droplets and does not disclose the multi-color printhead structure of the present invention.

U.S. Pat. No. 4,750,009 to Yoshimura discloses a multi-color ink jet printhead. This printhead includes a plurality of orifice groups (or nozzles) with each group being for a different color. One orifice group consists of a larger number of orifices than the other groups so that characters of higher definition can be printed out at a higher speed. The present invention is not taught or suggested by this reference.

There are also disadvantages to using a passive resistor array with a mono-color printhead. When a passive resistor array is used to address a plurality of heating elements 34, as shown in FIG. 1, the leads must be directed to the sides of feed slot 20. This creates a considerable gap "A" between the feed slot 20 and the end of chip 28. When two chips are butted to one another to form an array of chips (i.e., in forming a pagewidth printhead) a gap the size of two times "A" exists between adjacent feed slots 20. These gaps greatly reduce the resolution achievable since the number of nozzles per unit length is reduced.

OBJECTS OF THE INVENTION

It is an object of the present invention to provide a multi-color ink jet printhead suitable for use in high quality, high speed printing operations.

It is another object of the present invention to provide a multi-color roofshooter type thermal ink jet printhead wherein the color arrays are well aligned with each other.

It is another object of the present invention to provide a multi-color inkjet printhead which conserves silicon real estate while still enabling high quality, high speed printing to be performed.

It is another object of the present invention to provide an inexpensive four-color disposable "roofshooter" thermal ink jet printhead.

It is a further object of the present invention to provide a mono-color thermal ink jet printhead having high resolution capabilities.

SUMMARY OF THE INVENTION

The present invention makes use of switching circuitry such as an active driver matrix for each color array which reduces the number of lead lines required to address each heating element within the color array. Since the resistors and switching circuitry consume less surface area than the previously used passive resistor arrays, the present invention permits four different color printheads to be efficiently arranged on a single chip or wafer, so that silicon real estate is conserved. Since each color array requires less surface area than the previous color arrays, it is possible to place multi-color arrays, for example four color arrays, in a single bank on one wafer so that the printer need only store information on one scan line at a time. Additionally, placement of all four color arrays in a single bank permits them to be well aligned. By reducing the silicon wafer surface area required to fabricate a four color high quality, high speed inkjet printhead, fabrication costs are lowered so that a disposable four color printhead is possible. Furthermore, the use of switching circuitry in mono-color ink jet printheads eliminates the requirement of running the resistor lead lines to the side of the chip, enabling the production of printhead arrays having higher resolutions or higher speed operation. In a preferred embodiment, inputs of the switching circuitry extend from sides thereof, whereby distances between adjacent feed slots are minimized.

BRIEF DESCRIPTION OF THE DRAWINGS

The invention will be described in detail with reference to the following drawings, wherein.

DETAILED DESCRIPTION OF THE PREFERRED EMBODIMENT

The invention is described with reference to a four color printhead, but the invention is applicable to one or more color arrays such as mono- or multi-color arrays.

Figure 3:
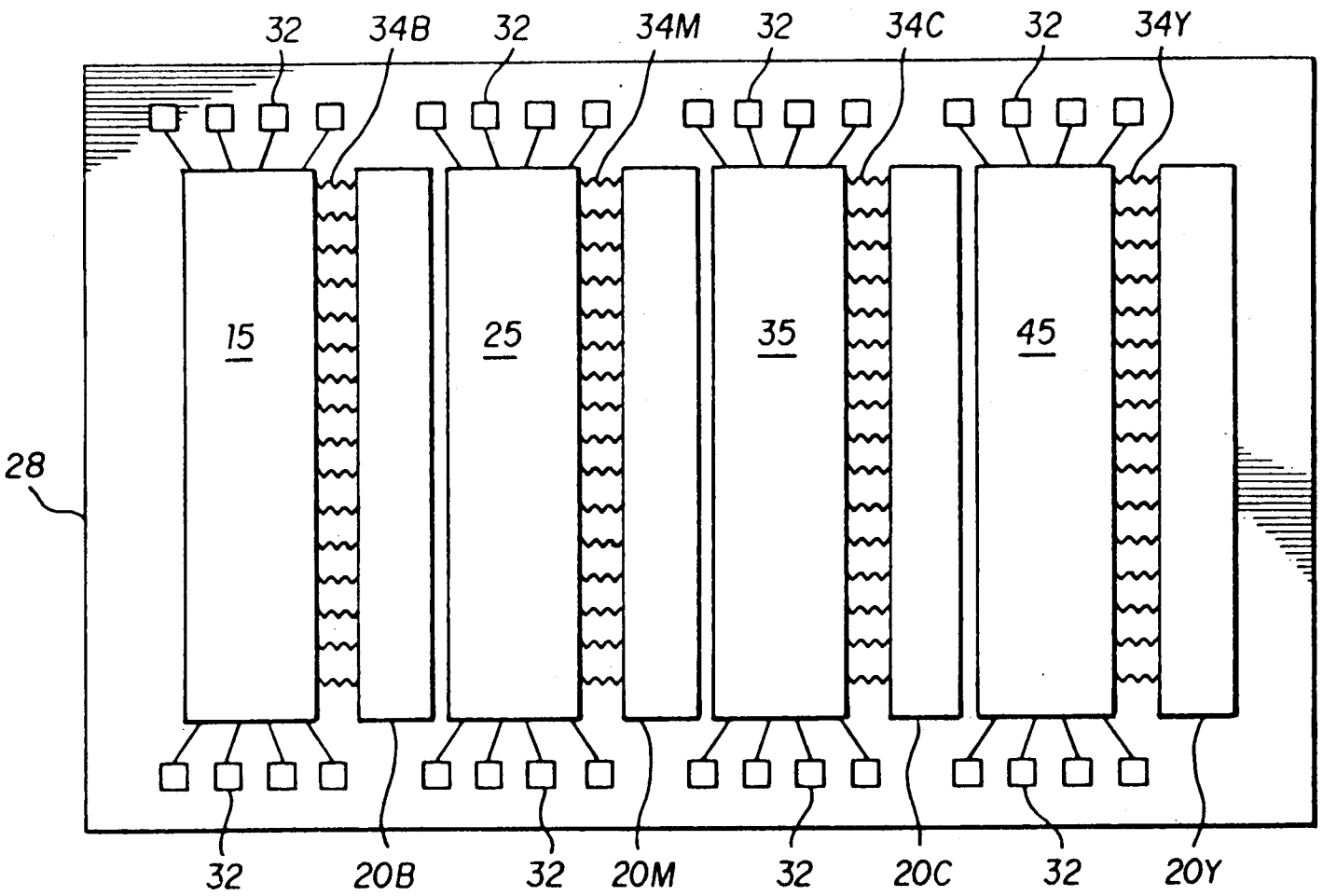
FIG. 3 is a plan view of a heater plate for a four-color roofshooter printhead in accordance with the present invention.

FIG. 3 shows a heater plate 28 for a four color roofshooter type thermal inkjet printhead of the present invention. The heater plate includes feed slots 20B, 20M, 20C, 20Y for the passage therethrough of each color (black, magenta, cyan and yellow, respectively) from a source of ink to an ink expelling nozzle. These fill slots are preferably formed by anisotropic etching, although other methods may be employed. The upper surface of the heater plate includes arrays of heater elements 34B, 34M, 34C, 34Y for each feed slot. When the heater plate 28 is assembled to form a complete printhead, each heater element is aligned with a nozzle so that when the resistor is activated it will vaporize ink in contact therewith and cause a drop of ink to be expelled from a nozzle.

Figure 1:
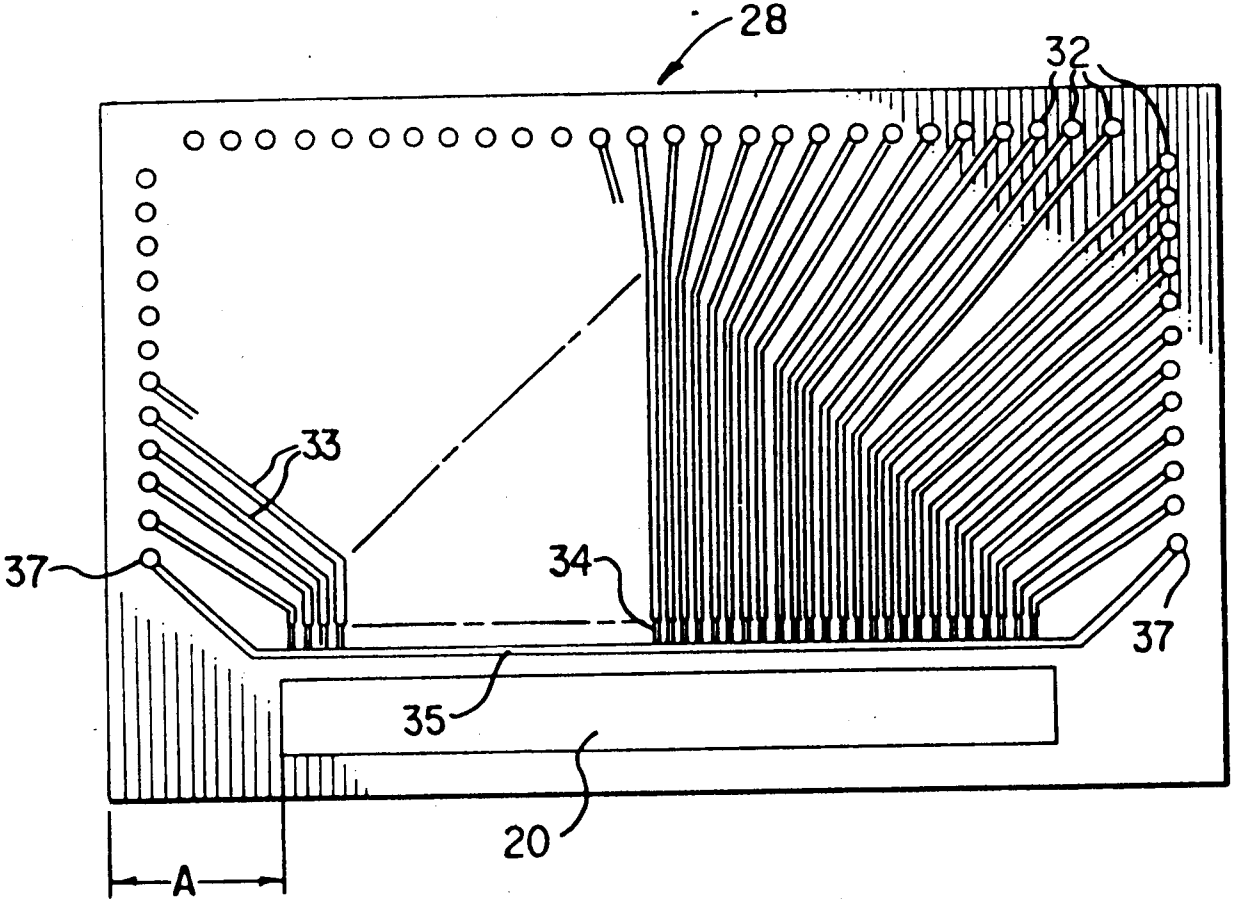
FIG. 1 PRIOR ART
FIG. 1 is a plan view of a heater plate containing a feed slot and passive resistor array for a single color printhead.
Figure 2:
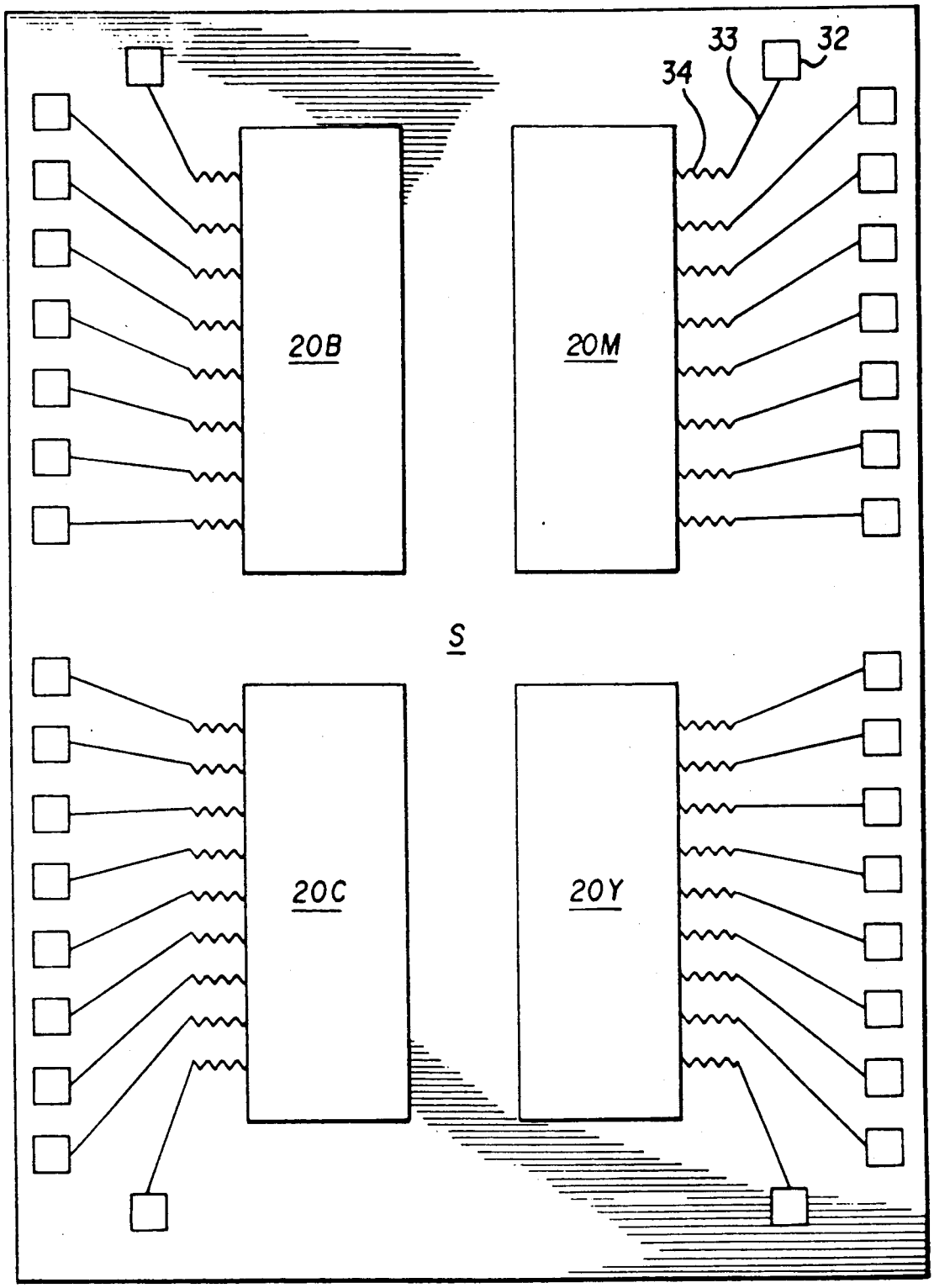
FIG. 2 PRIOR ART
FIG. 2 is a plan view of a heater plate for a four-color printhead using passive resistor arrays.

Instead of making use of a passive resistor array in which each heater element requires is own individual addressing electrode (see FIG. 1), the present invention makes use of switching circuitry 15, 25, 35, 45 for each resistor array. For purposes of the present invention, switching circuitry refers to any means for reducing the number of contact pads required for a given number of heating elements. One type of switching circuitry is, for example, active driver matrices. These active driver matrices enable each resistive element in each array of resistors to be addressed but require less addressing electrodes to do so. FIG. 3 illustrates each driver matrix with eight (8) addressing electrodes 32.

Figure 3A:
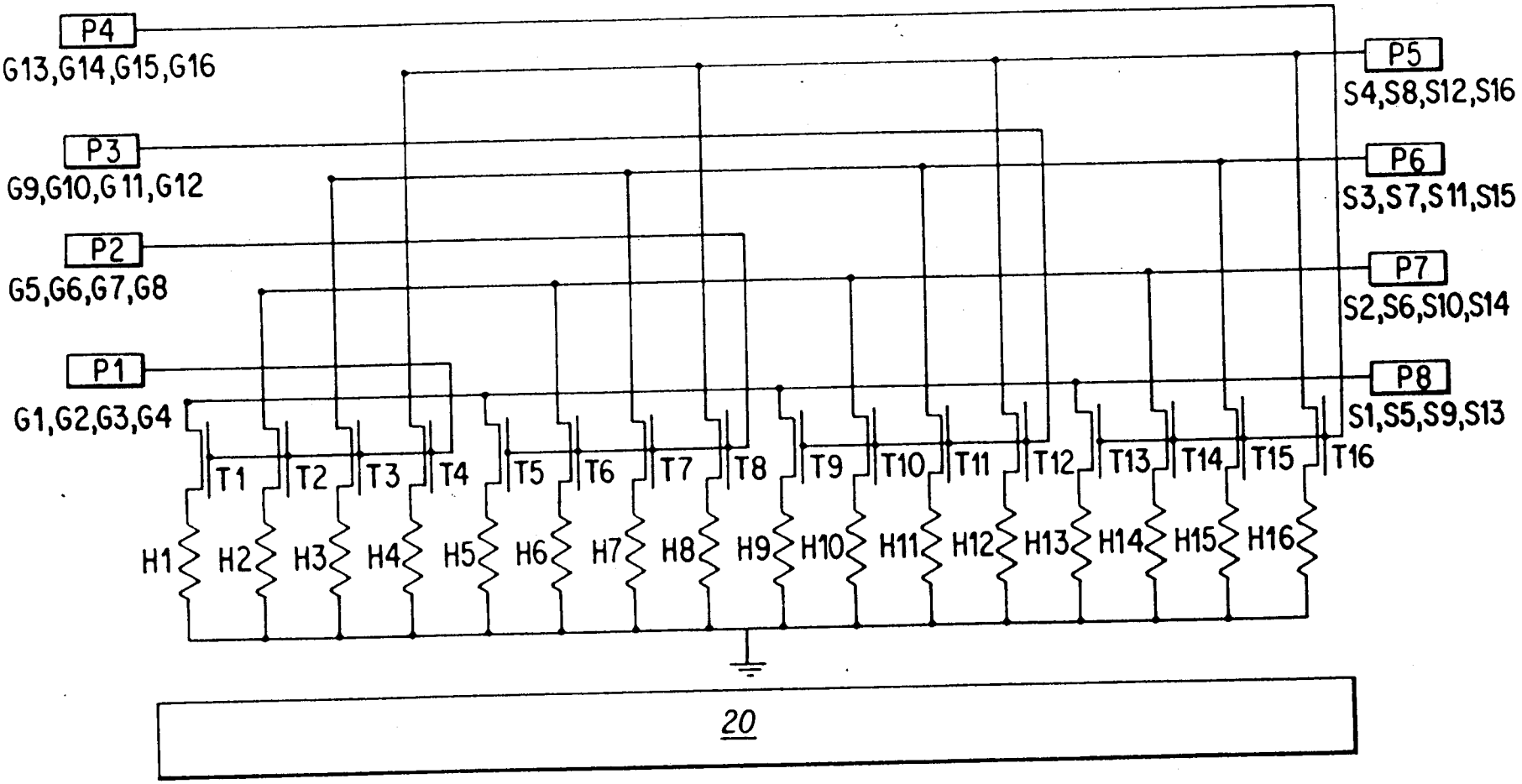
FIG. 3A is a schematic circuit diagram for the switching circuitry of FIG. 3.

FIG. 3A illustrates one type of switching circuitry for a sixteen heater arrangement, each heater having a drive transistor with a gate and a source. The left-side of the matrix in FIG. 3A has four gate addressing pads P1, P2, P3, P4 addressing groups of drive transistor gates. For example, pad P1 switches the gates G1, G2, G3. G4 on drive transistor T1, T2, T3, T4. The right side of the matrix in FIG. 3A has four source address pads P5, P6, P7, P8 addressing groups of drive transistor source lines. For example, pad P5 switches the source lines S4, S8, S12, S16 on drive transistors T4, T8, T12 and T16. Thus if it is desired to activate heater H4, address pads P1 and P5 are activated to uniquely activate heater H4. Groups of drain lines of the drive transistors are also suitable instead of using groups of drive transistor source lines as part of the matrix.

For purposes of the present invention, the combination of an active driver matrix and array of resistive elements is referred to as an "active resistor array". When combined with an array of resistors, the active driver matrix greatly reduces the contact leads required and permits them to exit via the sides of the feed slot. Thus a single color array which includes a feed slot/resistor array, active driver matrix and contact leads consumes less silicon wafer real estate than the previous color array using a passive resistor array, thereby enabling multi-color arrays to be located closer to each other so that relative drop placement is made easier.

An active driver matrix, such as disclosed in U.S. patent application Ser. No. 07/336,624, filed on Apr. 7, 1989, now U.S. Pat. No. 4,947,192, or U.S. Pat. No. 4,651,164, the disclosures of which are herein incorporated by reference, can be used in the present invention. By using an active driver matrix (which includes at least one driver chip), an addressing electrode 32 need not be provided for each resistive heating element 34. Instead, the electrodes from a plurality of resistive elements are connected to a first set of leads which are connected to the output pads of the active driver matrix. A second set of leads, which are connected to control signal and ground pads of the active driver matrix, are disposed at the sides of the feed slot. The second set of leads have addressing electrodes 32 which are attached to, e.g., a daughter board on the carriage of a printer which provides control signals to the active driver matrix and thus controls operation of the printhead. The number of addressing electrodes 32 required with an active driver matrix is about two times the square root of the number of resistive heater elements controlled (i.e., 81 heaters requires a 9 by 9 matrix and 18 electrodes). Since the active driver matrix requires less area than the resistive heater element leads required when no active driver matrix is used, considerable silicon real estate is conserved. In fact, a four-color printhead can be formed on a single silicon chip even though all four-color arrays are in a single bank. This permits a four-color roofshooter printhead to be produced having a high density arrangement of nozzle apertures and precisely aligned heater element arrays. Additionally, the printer need only store information on one scan line.

Figure 4:
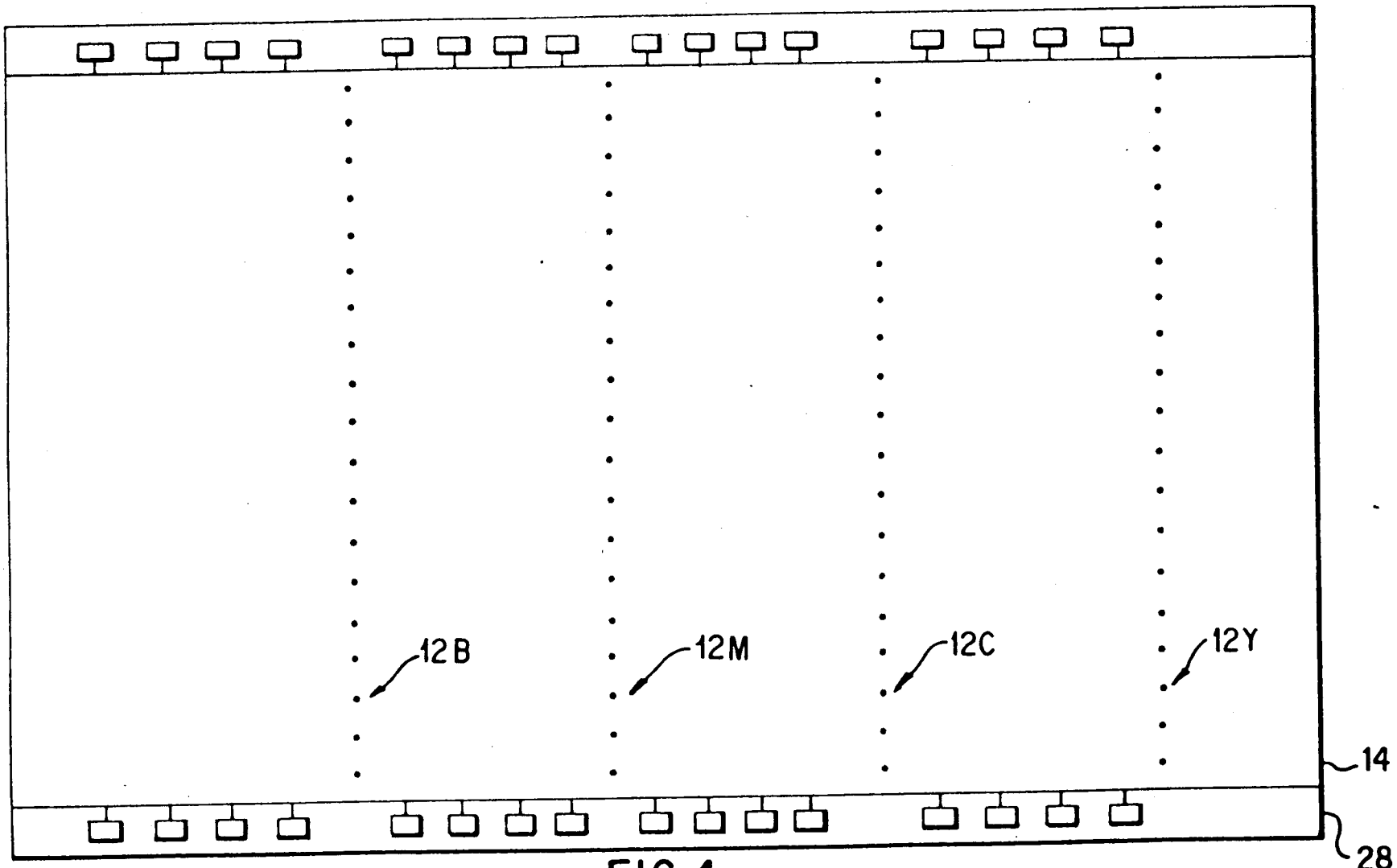
FIG. 4 is a plan view of a four-color "roofshooter" printhead in accordance with the present invention.

The present invention allows construction of a four color roofshooter type thermal inkjet printhead as shown in FIG. 4. The printhead includes: a common heater substrate 28 (FIG. 3) having four arrays of heating elements (34B, 34M, 34C, 34Y) and four corresponding elongated feed slots (20B, 20M, 20C, 20Y) with each heater array being located adjacent its corresponding feed slot; and a common channel substrate 14 (FIG. 4) layered above the heater substrate 28 and including four arrays of nozzles 12B, 12M, 12C, 12Y, each nozzle array 12B, 12M, 12C, 12Y communicating with one of the feed slots 20B, 20M, 20C, 20Y on the heater substrate 28, each nozzle array being isolated from an adjacent nozzle array and each nozzle 12 of each nozzle array being aligned above a respective heating element 34 of a corresponding heater array. (The individual heating elements 34 or feed slots 20 are not shown in FIG. 4 because they are obscured by the channel substrate 14.) Each of the four heater arrays 34B, 34M, 34C, 34Y is individually addressed and driven by a corresponding one of four active driver matricies 15, 25, 35, 45, each active driver matrix being located on the heater substrate 28 adjacent to its corresponding heater array. (Only the eight addressing electrodes 32 of each active driver matrix are shown in FIG. 4). Each of the driver matricies can be located on the heater plate to alternate with the locations of the feed slots, as shown in FIG. 3.

It can be seen from FIG. 3 that if all the heater and nozzle arrays 34B, 34M, 34C, and 34Y are all supplied with the same color ink, the resulting multi-array monochrome printhead can operate at a total drop ejection frequency four times higher than the maximum frequency of a single array. This is because each of the four heaters in line with a single scan line in the printhead scan direction need only address ¼ of the pixels in that single scan line. This concept is described in U.S. Pat. No. 4,833,491, granted May 33, 1989, using multiple, separate 'sideshooter' printheads (the disclosure of the '491 patent is herein incorporated by reference). The present invention is distinguishable from the '491 patent in that it proposes that the multiple roofshooter heater and nozzle arrays are monolithically formed in a single printhead. U.S. Pat. No. 4,899,181 granted Feb. 6, 1990 now U.S. Pat. No. 4,899,181, describes a monolithic multi-array, four color or monochrome printhead having a 'sideshooter' architecture (the disclosure of U.S. Pat. No. 4,899,181 is herein incorporated by reference). The present application is distinguishable from that application in that it relates to 'roofshooter' style thermal inkjet printheads.

Alternatively, if each nozzle/heater array is progressively offset in the array direction by ¼ pixel relative to the next adjacent array, then the monolithic multi-array monochrome printhead can have four times the maximum addressable resolution of a single array. For instance, if the maximum of a single array is 200 nozzles per inch the maximum resolution of a four array, ¼ pixel staggered monochrome printhead would be 800 nozzles per inch.

Furthermore, if each of the four feed slots supplies an array on each side of each feed slot, the total number of nozzle/heater arrays is eight and the maximum addressable resolution is eight times that of a single array on one side of a feed slot. These eight arrays could also be used to enable a printhead operating frequency eight times faster than the maximum drop ejection frequency of a single array, as previously described.

U.S. Pat. No. 4,789,425 to Drake et al, the disclosure of which is herein incorporated by reference, discloses methods of fabricating a roofshooter type thermal ink jet printheads applicable to the present invention. The present invention differs from that disclosed by Drake et al in that incorporation of active driver matrices in the integrated circuitry which forms the heater element arrays permits four sets of heater element arrays to be formed on a single silicon chip.

Figure 5A:
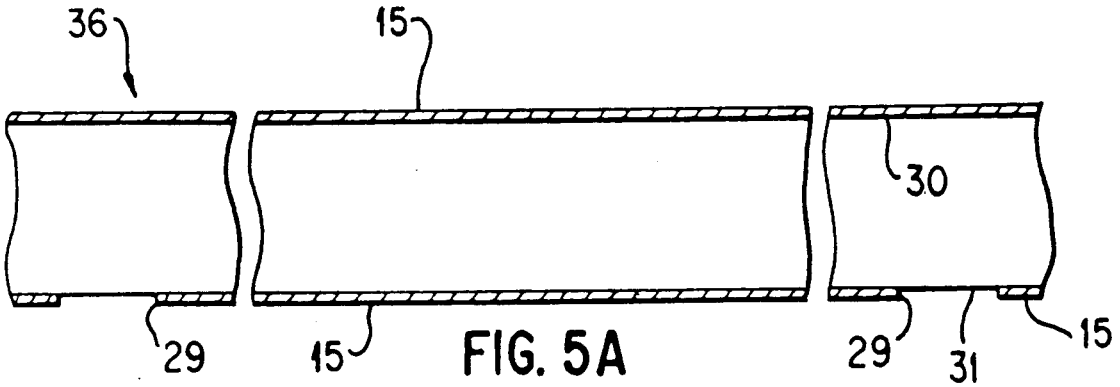
FIGS. 5A–5G are cross-sectional views of a silicon wafer and depict the process for producing the heating element substrate for a single color array.
Figure 5B:
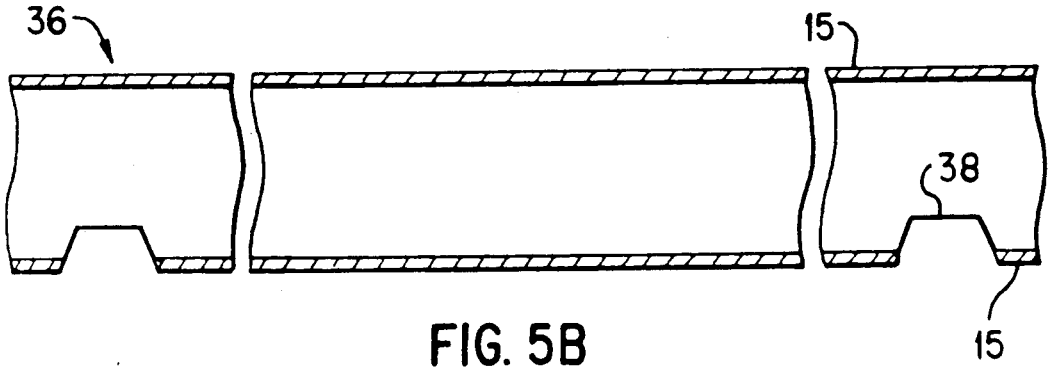
Figure 5C:
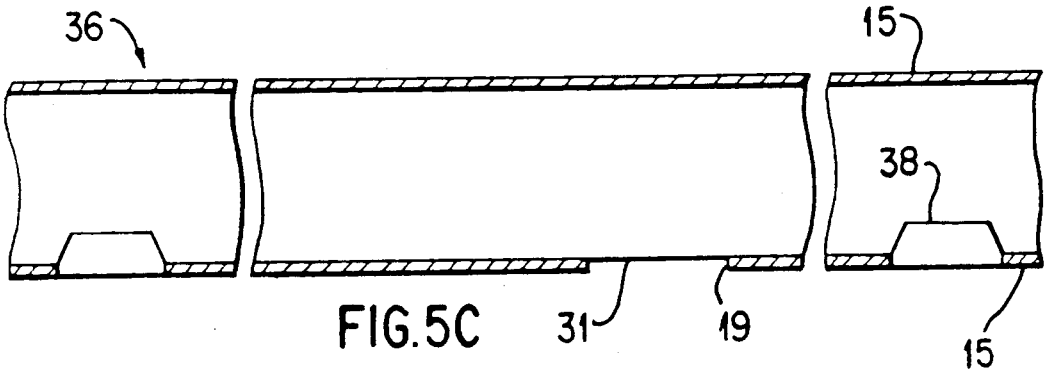
Figure 5D:
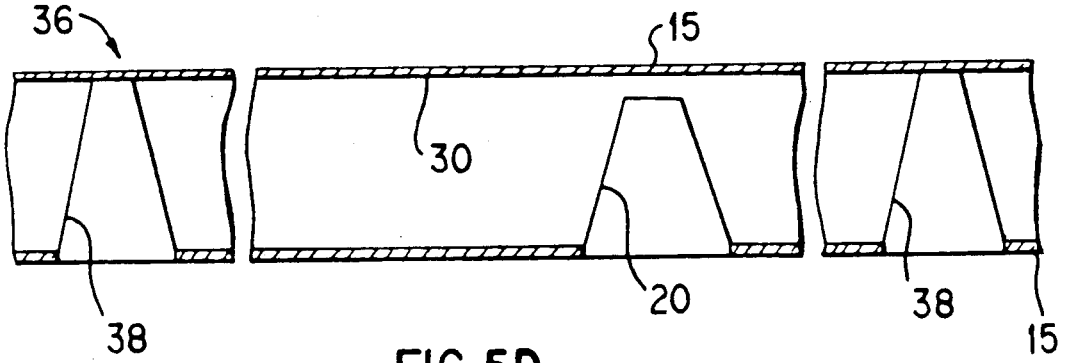

FIGS. 5A–5G show a portion of a heater plate made by the invention wherein only one color array is shown. It is understood that each color array is identically formed. A (100) silicon wafer 36 (FIG. 5A) is obtained and a masking film of silicon nitride 15 is deposited on both sides thereof. Alignment hole patterns are partially anisotropically etched through vias 29 into the wafer at two or three different locations and then the etching is terminated when the recessess 38 reach about 2 mils or 50 micrometers deep (FIG. 5B). These alignment holes are used to precisely align the patterns which form the feed slots 20 and heater element arrays 34 on the heater plate (FIG. 5E), thus enabling a plurality of wafer subunits (or chips) to be produced from a single wafer. In the next step (FIG. 5C), a mask having the alignment marks and ink fill slot patterns is aligned and imaged on the wafer side which contains the alignment hole recesses 38. The wafer is again anisotropically etched until the alignment holes 38 etch completely through the wafer (FIG. 5D), leaving only the substantially transparent masking film 15 covering them, and then the etch process is stopped leaving the elongated feed slots 20 approximately 2 mils or 50 micrometers short of etching completely through the wafer. Except for the two or three alignment holes (covered by the masking film), the entire wafer surface 30 is solid. Therefore, the heating elements and active driver matrices can be formed on the solid surface 30 of the wafer.

Figure 5E:
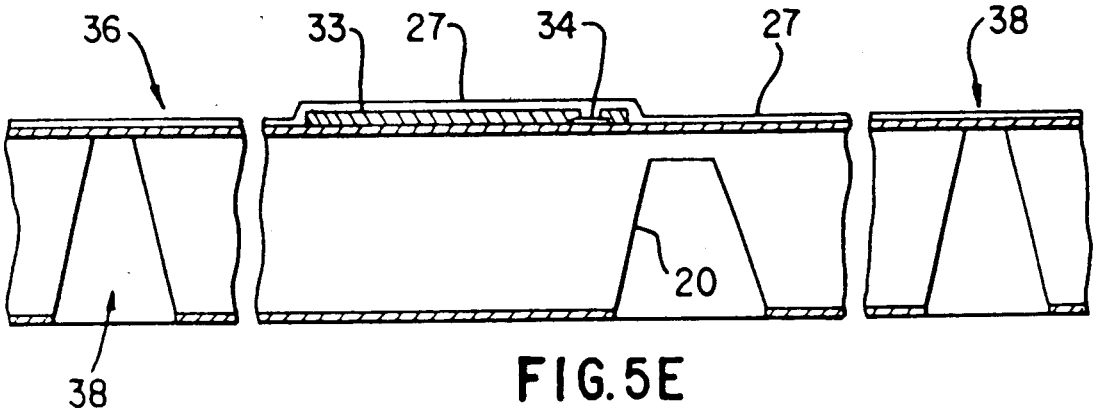
Figure 5F:
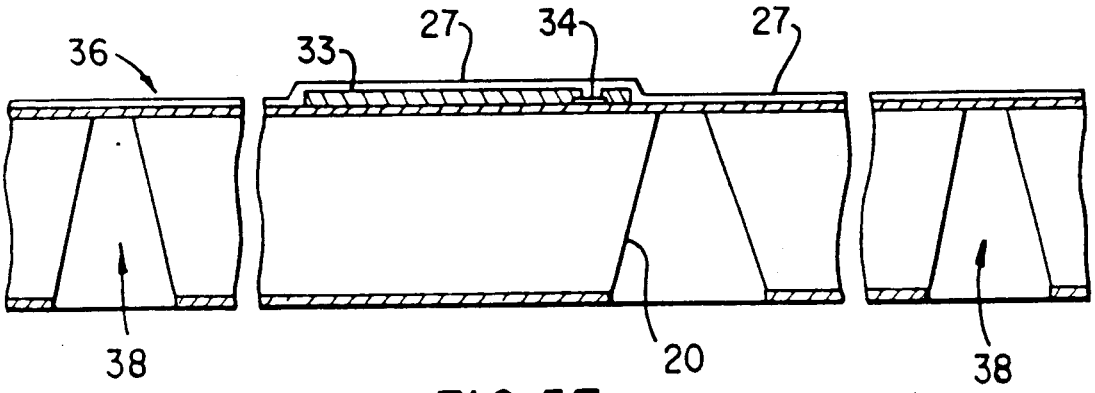
Figure 5G:
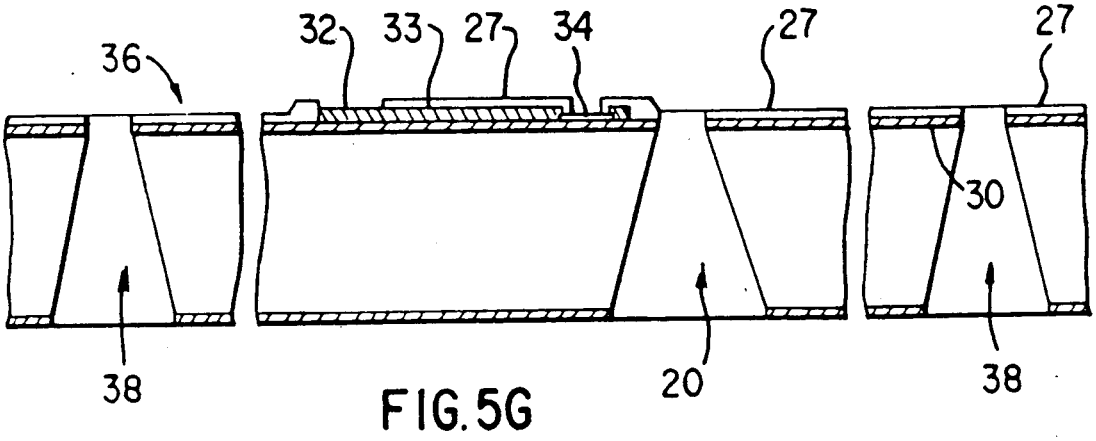

A plurality of sets of bubble generating heating elements 34 (FIG. 5E) are patterned on the masking film on the solid surface 30 of silicon wafer 36 along with its associated electrode 33. Since the present invention does not require as much silicon surface area to contain the heating element array circuitry as was previously required, four fill slots and their associated heating element circuitry can be formed on a single wafer subunit. After the electrodes 33 and heating elements 34 are patterned on the solid surface of the silicon wafer, the active driver matrices 15, 25, 35, 45 are fabricated on the surface in a manner disclosed in U.S. Ser. No. 07/336,624 filed Apr. 7, 1989 or U.S. Pat. No. 4,651,164. For electrode passivation, a 1 micron thick phosphorus doped chemical vapor deposition (CVD) silicon dioxide film 27 is deposited over the entire plurality of sets of heating elements, active driver matrices and addressing electrodes as shown in FIG. 5E. After the final CVD silicon dioxide passivation coat is deposited, the wafer is placed in an anisotropic etch having a slow silicon dioxide to silicon etch rate, for example, ethylene diamine pyrocatechol (EDP). This orientation dependent etching will complete the ODE etching of the elongated ink fill troughs 20, so that the bottom of this etched trough is now covered only by the passivation layer 27 and masking film 115 (or substituted under glaze layer) as shown in FIG. 5F. In FIG. 5G, the passivation layer and masking film are etched off of the terminal ends of the addressing electrodes 33, the heating elements 34, the alignment holes 38 and elongated ink fill slots 20.

Figure 6A:
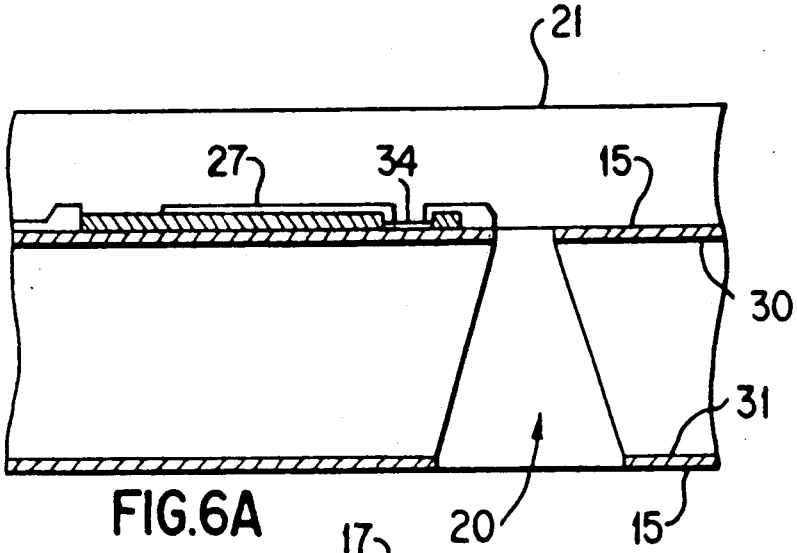
FIGS. 6A–6C are enlarged schematic plan views depicting the process for producing the channel substrate of a roofshooter printhead.
Figure 6B:
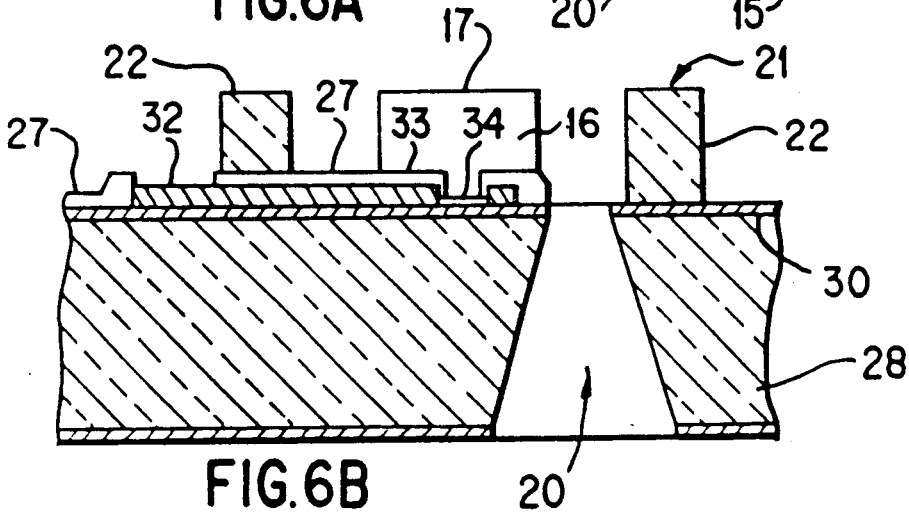
Figure 6C:
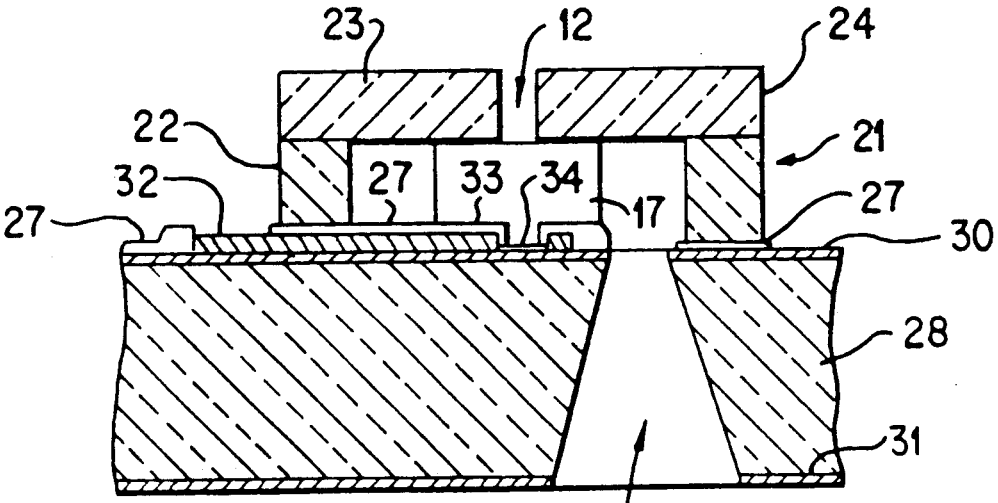

After the heater plate is formed, a common channel substrate 14 is formed on the surface of the heater plate which contains the heating elements. This can be performed in a number of ways as disclosed in U.S. Pat. No. 4,789,425. One method is illustrated in FIGS. 6A–6C. A layer of patternable material 21 in dry film form is applied to the etched silicon heater plate 28. Patternable materials are those which can be delineated by photosensitization, exposure, and development or by wet or dry etching through a pattern mask. For example, polyimide materials may be applied in dry film form as photosensitive layers using such products as DuPont VACREL, followed by ultraviolet pattern exposure, development and cure. In FIG. 6B, the cavity wall 22 and channel wall 17 patterns are aligned, imaged and developed from patternable material layer 21. In FIG. 6C, a dry film photoresist 23 is placed on the patternable material layer 21 and aligned, imaged, and developed to form a roof 24, having the array of nozzles 12 therein.

Figure 7:
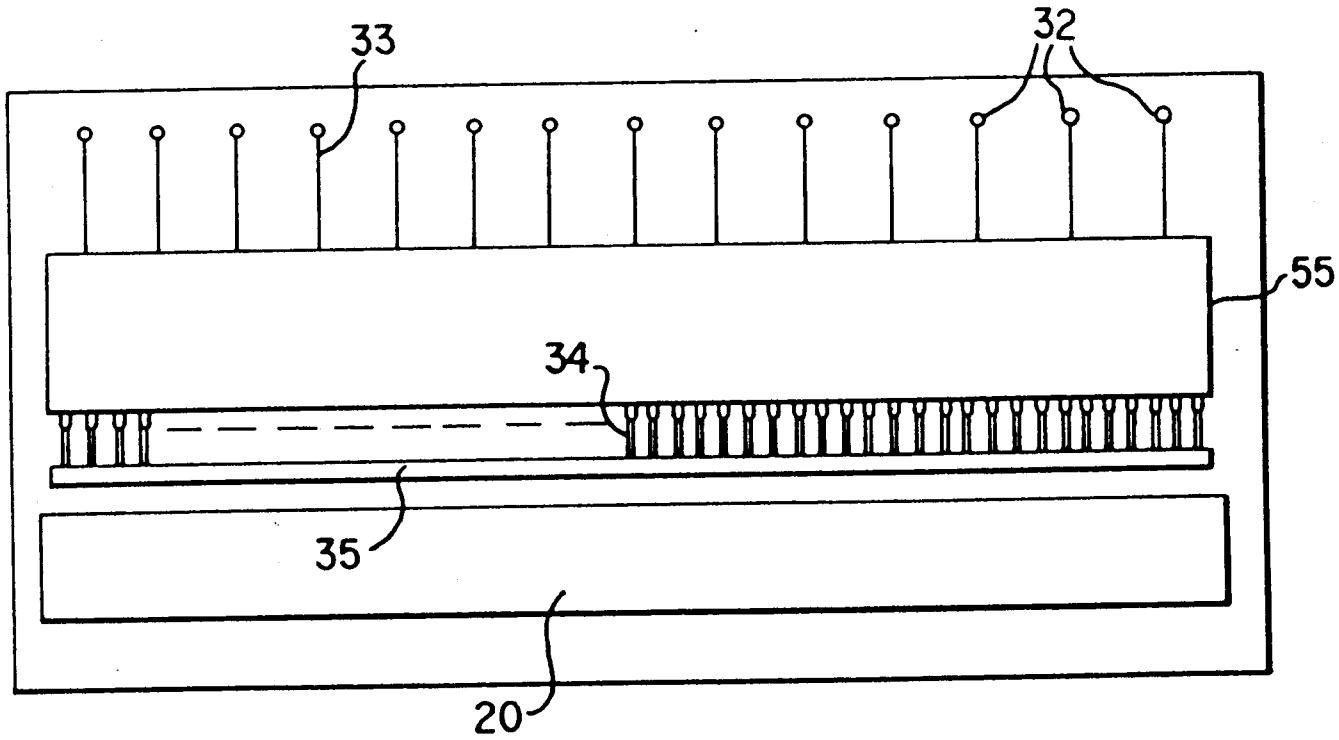
FIG. 7 is a plan view of a heater plate containing a feed slot and switching circuitry for a single color printhead.

The present invention is also applicable to mono-color printheads of the sideshooter or roofshooter type. FIG. 7 shows a heater plate for a mono-color roofshooter printhead. The printhead includes a feed slot 20, an associated array of heating elements 34 and a common return 35. By using switching circuitry such as an active driver matrix 55 to address heating elements 34, the number of addressing electrodes 32 required is greatly reduced. This reduction of addressing electrodes 32 permits an arrangement whereby none of the electrical leads 33 run to the sides of the feed slot 20. This permits feed slot 20 to extend virtually the entire width of the heater plate which reduces the gap between feed slots 20 of adjacent heater plates when butted end-to-end to form large printhead arrays. The present invention permits longer arrays of nozzles to be placed on a single chip which results in higher resolution print quality, while saving silicon real estate. Although the heater plate illustrated in FIG. 7 is for roofshooter printheads, switching circuits can also be used with mono-color sideshooter printheads to achieve similar advantages.

The invention has been described with reference to a preferred embodiment thereof, which is intended to be illustrative and not limiting. Many modifications and variations are apparent from the foregoing description of the invention and all such modifications and variations are intended to be within the scope of the present invention. For example, the present invention finds use in any type of multi-color ink jet printhead where it is desirable to provide a series of well-aligned, closely packed arrays of nozzles. Accordingly, variations of the invention may be made without departing from the spirit and scope of the present invention as defined in the following claims.

What is claimed is:

1. A multi-color thermal inkjet printhead comprising:

a common heater substrate having at least two arrays of heating elements and a corresponding number of elongated feed slots, each heater array being located adjacent its corresponding feed slot and extending along substantially the entire length of its corresponding feed slot;

a common channel substrate layered above said heater substrate and including an array of nozzles for each array of heating elements, each nozzle array communicating with one of said feed slots on the heater substrate, each nozzle array being isolated from an adjacent nozzle array and each nozzle of each nozzle array being aligned above a respective heating element of a corresponding heater array; and each of said at least two heater arrays being individually addressed and driven by a corresponding switching circuitry means, each switching circuitry means being located on said heater substrate adjacent to its corresponding heater array, each switching circuitry means having a first number of outputs, each output attached to a heater element in its corresponding array of heater elements, and a second number of inputs for receiving control signals, the second number being less than the first number, and wherein each of said switching circuitry means includes opposite sides which extend substantially perpendicular to a direction in which each feed slot extends, and wherein said inputs extend from said sides of their corresponding switching circuitry means, whereby distances between adjacent feed slots are minimized.

2. The thermal inkjet printhead of claim 1, wherein locations of said switching circuitry means alternate with locations of said feed slots.

3. The thermal inkjet printhead of claim 1, wherein said switching circuitry means is an active driver matrix.

4. A four color roofshooter type thermal inkjet printhead comprising:

a common heater substrate having four arrays of heating elements and four corresponding elongated feed slots, each heater array being located adjacent its corresponding feed slot and extending along substantially the entire length of its corresponding feed slot;

a common channel substrate layered above said heater substrate and including four arrays of nozzles, each nozzle array communicating with one of said feed slots on the heater substrate, each nozzle array being isolated from an adjacent nozzle array and each nozzle of each nozzle array being aligned above a respective heating element of a corresponding heater array; and each of said four heater arrays being individually addressed and driven by a corresponding one of four switching circuitry means, each switching circuitry means being located on said heater substrate adjacent to its corresponding heater array, each switching circuitry means having a first number of outputs, each output attached to a heater element in its corresponding array of heater elements, and a second number of inputs for receiving control signals, the second number of inputs being less than the first number of outputs, and wherein each of said switching circuitry means includes opposite sides which extend substantially perpendicular to a direction in which each feed slot extends, and wherein said inputs extend from said sides of their corresponding switching circuitry means, whereby distances between adjacent feed slots are minimized.

5. The thermal inkjet printhead of claim 4, wherein locations of said switching circuitry means alternate with locations of said feed slots.

6. The thermal ink jet printhead of claim 4, wherein said switching circuitry is an active driver matrix.

* * * * *

US005030971B1

REEXAMINATION CERTIFICATE (4217th)

United States Patent [19]

Drake et al.

[11] B1 5,030,971

[45] Certificate Issued Nov. 28, 2000

[54] PRECISELY ALIGNED, MONO- OR MULTI-COLOR, 'ROOFSHOOTER' TYPE PRINTHEAD

[75] Inventors: Donald J. Drake, Rochester; William G. Hawkins, Webster, both of N.Y.

[73] Assignee: Xerox Corporation, Fairfield, Conn.

Reexamination Request:
No. 90/005,335, Apr. 20, 1999

Reexamination Certificate for:

| | |
|---|---|
| Patent No.: | **5,030,971** |
| Issued: | **Jul. 9, 1991** |
| Appl. No.: | **07/442,574** |
| Filed: | **Nov. 29, 1989** |

[51] Int. Cl.[7] ..... B41J 2/05

[52] U.S. Cl. ..... 347/57; 347/43

[58] Field of Search ..... 347/57–59, 65, 347/12, 13, 208, 209, 210, 180–182; 307/115, 139; 327/403; 257/786; 361/777; 174/261

[56] References Cited

U.S. PATENT DOCUMENTS

| | | | |
|---|---|---|---|
| 3,555,241 | 1/1971 | Carlsen et al. . | |
| 3,564,556 | 2/1971 | Tsukatani | 347/145 |

(List continued on next page.)

FOREIGN PATENT DOCUMENTS

| | | | |
|---|---|---|---|
| 0 103 943 A2 | 3/1984 | European Pat. Off. . | |
| 0 109 755 B1 | 5/1984 | European Pat. Off. . | |
| 0 110 533 A2 | 6/1984 | European Pat. Off. . | |
| 0 110 534 B1 | 6/1984 | European Pat. Off. . | |
| 0 124 311 B1 | 11/1984 | European Pat. Off. . | |
| 3717294 | 12/1987 | Germany | B41J 3/04 |
| 52-28292 | 3/1977 | Japan . | |
| 55-128743 U | 9/1980 | Japan . | |
| 59-131466 | 7/1984 | Japan . | |
| 60-203455 | 10/1985 | Japan . | |
| 61-125856 | 6/1986 | Japan . | |
| 61-181727 U | 11/1986 | Japan . | |
| 62-28534 U | 3/1987 | Japan . | |
| 62-220345 | 9/1987 | Japan . | |
| 1-80343 U | 5/1989 | Japan . | |
| 1-80345 U | 5/1989 | Japan . | |
| 1-241450 | 9/1989 | Japan . | |

OTHER PUBLICATIONS

D.J. Drake & W.G. Hawkins, "Precisely Aligned Four–Color Thermal Drop on Demand Ink Jet Printhead," *Xerox Disclosure Journal*, vol. 13, No. 2, Mar./Apr. 1988, pp. 61–64.

IEEE International Solid–State Circuits Conference (1983), Digest of Technical Papers, Session VI: CMOS Memory, WPM 6.2: A 64Kb Full CMOS RAM with Divided Word Lein Structure:, M. Yoshimoto et al., pp. 58, 59, 28.

(List continued on next page.)

*Primary Examiner*—Huan Tran

[57] ABSTRACT

A multi-color roofshooter type thermal ink jet printhead includes a common heater substrate having at least two arrays of heating elements and a corresponding number of elongated feed slots, each heater array being located adjacent its corresponding feed slot. A common channel substrate is layered above a heater substrate and includes arrays of nozzles corresponding in number to the arrays of heating elements, each nozzle array communicating with one of the feed slots on the heater substrate. Each nozzle array is isolated from an adjacent nozzle array and each nozzle of each nozzle array is aligned above a respective heating element of a corresponding heater array. Each of the heater arrays is individually addressed and driven by switching circuitry located on the heater substrate adjacent to its corresponding heater array. The switching circuitry can be active driver matrices corresponding in number to the arrays of heating elements. The locations of the driver matrices preferably alternate with locations of the feed slots. With this construction, multi-color printheads can be efficiently arranged on a single wafer, so that silicon real estate is conserved. The switching circuitry can also be used to address an array of heating elements in a mono-color thermal inkjet printhead. In a preferred embodiment, inputs of the switching circuitry extend from sides of the switching circuitry whereby distances between adjacent feed slots are minimized.

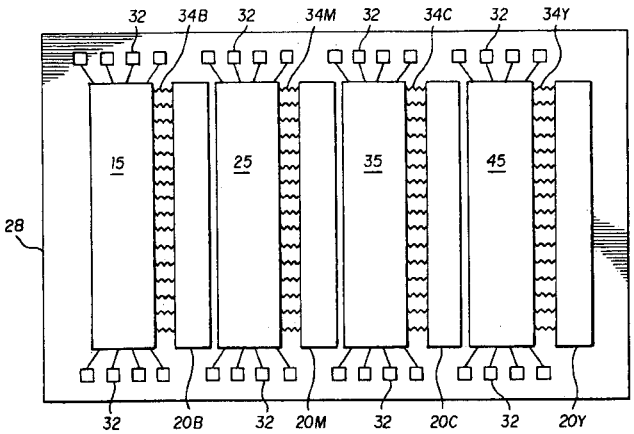

U.S. PATENT DOCUMENTS 3,700,852 10/1972 Ruggiero .
3,852,563 12/1974 Bohorquez et al. .
3,916,419 10/1975 Fan et al. .
3,971,033 7/1976 Fan et al. .
3,982,251 9/1976 Hochberg .
4,017,712 4/1977 Baraff et al. .
4,055,743 10/1977 Conta et al. .
4,110,598 8/1978 Small .
4,123,647 10/1978 Oda .
4,186,406 1/1980 Bahr et al. .
4,194,108 3/1980 Nakajima et al. .
4,216,481 8/1980 Hakoyama .
4,245,258 1/1981 Holladay .
4,246,076 1/1981 Gardner .
4,250,375 2/1981 Tsutsumi et al. .
4,252,991 2/1981 Iwabushi .
4,315,135 2/1982 Tokugawa et al. .
4,322,733 3/1982 Moriguchi et al. .
4,340,893 7/1982 Ort .
4,347,524 8/1982 Engel et al. .
4,349,828 9/1982 Fischbeck et al. .
4,358,775 11/1982 Jinnai .
4,366,489 12/1982 Yamaguchi .
4,374,707 2/1983 Pollack .
4,379,300 4/1983 Fischbeck .
4,379,301 4/1983 Fischbeck .
4,380,017 4/1983 Ort .
4,381,515 4/1983 Bain .
4,382,263 5/1983 Fischbeck et al. .
4,389,652 6/1983 Fischbeck .
4,389,654 6/1983 Bar-on et al. .
4,395,146 7/1983 Arai .
4,410,895 10/1983 Houston et al. .
4,429,321 1/1984 Matsumoto ..... 347/59
4,438,191 3/1984 Cloutier et al. .
4,441,110 4/1984 Hatakeyama et al. .
4,446,355 5/1984 Sato et al. .
4,447,817 5/1984 Naramore .
4,447,819 5/1984 Moriguchi et al. .
4,458,256 7/1984 Shirato .
4,459,462 7/1984 Rakes et al. .
4,463,359 7/1984 Ayata et al. .
4,485,386 11/1984 Dagna et al. .
4,499,478 2/1985 Matsufuji et al. .
4,500,895 2/1985 Buck et al. .
4,502,060 2/1985 Rankin et al. .
4,509,057 4/1985 Sohl et al. .
4,513,298 4/1985 Scheu .
4,520,368 5/1985 Ims .
4,520,374 5/1985 Koto .
4,524,364 6/1985 Bain et al. .
4,528,577 7/1985 Cloutier et al. .
4,532,530 7/1985 Hawkins .
4,549,191 10/1985 Fukuchi et al. .
4,550,326 10/1985 Allen et al. .
4,558,333 12/1985 Sugitani et al. .
4,559,543 12/1985 Toganoh et al. .
4,568,953 2/1986 Aoki et al. .
4,571,598 2/1986 Shinozaki et al. .
4,571,599 2/1986 Rezanka .
4,575,737 3/1986 Vermot-Gaud et al. .
4,586,056 4/1986 Okamura et al. .
4,587,534 5/1986 Saito et al. .
4,591,877 5/1986 Shiratsuki .
4,601,777 7/1986 Hawkins .
4,611,219 9/1986 Sugitani et al. .
4,630,076 12/1986 Yoshimura .
4,639,748 1/1987 Drake et al. .
4,651,164 3/1987 Abe et al. .
4,675,692 6/1987 Goshima et al. .
4,675,700 6/1987 Nagira et al. .
4,678,529 7/1987 Drake et al. .
4,678,680 7/1987 Abowitz .
4,683,481 7/1987 Johnson ..... 347/65
4,683,646 8/1987 Kando et al. .
4,684,960 8/1987 Nishiwaki .
4,695,853 9/1987 Hackleman at al. ..... 347/62
4,695,854 9/1987 Cruz-Uribe .
4,695,855 9/1987 Ichihashi et al. .
4,709,248 11/1987 Piatt et al. .
4,719,477 1/1988 Hess ..... 347/59
4,723,129 2/1988 Endo et al. .
4,728,963 3/1988 Rasmussen et al. .
4,734,717 3/1988 Rayfield .
4,737,041 4/1988 Nakayama .
4,746,935 5/1988 Allen .
4,748,453 5/1988 Lin et al. .
4,750,009 6/1988 Yoshimura .
4,769,648 9/1988 Kishino et al. .
4,771,295 9/1988 Baker et al. .
4,774,529 9/1988 Paranjpe et al. .
4,775,868 10/1988 Sugiura .
4,779,107 10/1988 Weisfield et al. .
4,786,357 11/1988 Campanelli et al. .
4,789,425 12/1988 Drake et al. .
4,789,870 12/1988 Lacord et al. .
4,791,440 12/1988 Eldridge ..... 347/58
4,797,692 1/1989 Ims .
4,806,947 2/1989 Vegeais et al. .
4,809,428 3/1989 Aden et al. .
4,812,859 3/1989 Chan et al. .
4,814,562 3/1989 Langston .
4,822,755 4/1989 Hawkins et al. .
4,829,324 5/1989 Drake et al. .
4,833,491 5/1989 Rezanka .
4,851,371 7/1989 Fischer et al. .
4,853,718 8/1989 ElHatem et al. .
4,860,030 8/1989 Pond et al. .
4,864,329 9/1989 Kneezel et al. ..... 347/67
4,872,027 10/1989 Buskirk et al. .
4,875,968 10/1989 O'Neill .
4,878,992 11/1989 Campanelli .
4,881,839 11/1989 Grimm .
4,887,098 12/1989 Hawkins ..... 347/58
4,899,178 2/1990 Tellier .
4,908,638 3/1990 Albosta et al. .
4,914,562 4/1990 Abe et al. ..... 347/63
4,914,736 4/1990 Matsuda ..... 347/63
4,935,750 6/1990 Hawkins .
4,935,752 6/1990 Hawkins .
4,942,408 7/1990 Braun .
4,947,192 8/1990 Hawkins ..... 347/59
4,947,193 8/1990 Deshpande .
4,951,063 8/1990 Hawkins et al. .
4,961,821 10/1990 Drake et al. .
5,000,811 3/1991 Campanelli .
5,016,023 5/1991 Chan et al. .
5,017,941 5/1991 Drake .
5,019,675 5/1991 Blessington et al. .
5,025,271 6/1991 Baker et al. .
5,092,690 3/1992 Grimm et al. .
5,107,276 4/1992 Kneezel et al. .
5,215,395 6/1993 Grimm .

OTHER PUBLICATIONS

IEEE Journal of Solid–State Circuits (1984), vol. SC–19, No. 5, "An 18 ns 4K X 4 CMOS SRAM", L. F. Childs et al., pp. 545–551.

IEEE Journal of Solid–State Circuits (1980), vol. SC–15, No. 4, "2K x 8 Bit Hi–CMOS State RAM's", O. Minato et al., pp. 656–659.

IEEE Journal of Solid–State Circuits (1984), vol. SC–19, No. 5, "The Design and Performance of CMOS 256K Bit DRAM Devices", A. Mohsen et al., pp. 610–618.
The Society of Photographic Scientists and Engineers, Proceedings of the First International Congress (1981), "Advances in non–impact printing technologies for computer and office applications", J. Gaynor, pp. 811–819.
Printing Abstracts, Nov. 1989, vol. 44, No. 11, pp. 1200–1201.
Printing Abstracts, Aug. 1989, vol. 44, No. 8, p. 830.
Printing Abstracts, Jul. 1989, vol. 44, No. 7, p. 730.
Printing Abstracts, May 1988, vol. 43, No. 5, p. 401.
Printing Abstracts, Apr. 1988, vol. 43, No. 4, p. 312.
Printing Abstracts, Apr. 1985, vol. 40, No. 4, p. 271.
Printing Abstracts, May 1984, vol. 39, No. 5, p. 367.
Hewlett–Packard Journal, May 1985, vol. 36, No. 5, Niels J. Nielsen et al., pp. 1–40.
Hewlett–Packard Journal, Aug. 1988, Jeffrey P. Baker et al., pp. 1–88.
IBM Technical Disclosure Bulletin, Jun. 1981, vol. 24, No. 1A, "On–board logic for multi–dot thermal printhead", J.V. Mizzi, pp. 284–288.
IBM Technical Disclosure Bulletin, Oct. 1973, vol. 16, No. 5, "Thermal printer chip protection circuit", J.H. Hong, pp. 1422–1423.
Xerox Disclosure Journal, Mar./Apr. 1988, vol. 13, No. 2, "Precisely aligned four–color continuous ink jet drop generator", DOnald J. Drake, pp. 57–60.
Xerox Disclosure Journal, May/Jun. 1988, vol. 13, No. 3, "Ink temperature control for continuous ink jet using thin film resistors", Donald J. Drake, pp. 127–129.
Xerox Disclosure Journal, Jan./Feb. 1989, vol. 14, No. 1, "Channel plate fabrication in an ink jet printer", William G. Hawkins et al., p. 5.
Xerox Disclosure Journal, May/Jun. 1989, vol. 14, No. 3, "Roof clamping for roofshooter thermal ink jet printhead", Donald J. Drake, pp. 111–115.
Xerox Disclosure Journal, May/Jun. 1989, vol. 14, No. 3, Binary continuous thermal ink jet break off length modulation;, pp. 95–100.
Xerox Disclosure Journal, Sep./Oct. 1989, vol. 14, No. 5, "Monolithic continuous ink jet printhead", Donald J. Drake et al., pp. 225–226.
Xerox Disclosure Journal, Jan./Feb. 1983, vol. 8, No. 1, "An electrical Interconnection system", D.R. Blessington, pp. 29–30.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–6 is confirmed.

* * * * *